US011152740B2

(12) United States Patent
Xu et al.

(10) Patent No.: US 11,152,740 B2
(45) Date of Patent: Oct. 19, 2021

(54) WATERPROOF CONNECTOR

(71) Applicant: Dongguan Leader Precision Industry Co., Ltd., Qingxi Town (CN)

(72) Inventors: Hongqiang Xu, Qingxi Town (CN); Lijun Xu, Qingxi Town (CN)

(73) Assignee: DONGGUAN LEADER PRECISION INDUSTRY CO., LTD., Qingxi Town Dongguan (CN)

( * ) Notice: Subject to any disclaimer, the term of this patent is extended or adjusted under 35 U.S.C. 154(b) by 0 days.

(21) Appl. No.: 16/890,785

(22) Filed: Jun. 2, 2020

(65) Prior Publication Data

US 2021/0210896 A1 Jul. 8, 2021

(30) Foreign Application Priority Data

Jan. 7, 2020 (CN) ..... 202010013409.2

(51) Int. Cl.

| | |
|---|---|
| ***H01R 13/52*** | (2006.01) |
| ***H01R 12/71*** | (2011.01) |
| ***H01R 43/00*** | (2006.01) |
| ***H01R 43/24*** | (2006.01) |

(52) U.S. Cl.

CPC ..... *H01R 13/5202* (2013.01); *H01R 12/716* (2013.01); *H01R 13/5216* (2013.01); *H01R 13/5219* (2013.01); *H01R 43/005* (2013.01); *H01R 43/24* (2013.01)

(58) Field of Classification Search

CPC ..... H01R 12/716; H01R 13/5202; H01R 13/5216; H01R 13/5219; H01R 43/005; H01R 43/24

USPC ..... 439/271

See application file for complete search history.

(56) References Cited

U.S. PATENT DOCUMENTS

| | | | | |
|---|---|---|---|---|
| 9,413,098 | B2 * | 8/2016 | Chien | H01R 13/521 |
| 9,437,956 | B2 * | 9/2016 | Fukami | H01R 43/24 |
| 9,793,644 | B2 * | 10/2017 | Fujii | H01R 24/64 |
| 9,893,459 | B2 * | 2/2018 | Zhao | H01R 13/5219 |
| 10,164,370 | B2 * | 12/2018 | Ono | H01R 13/405 |
| 10,177,488 | B2 * | 1/2019 | Zhao | H01R 13/5219 |
| 10,355,394 | B2 * | 7/2019 | Zhang | H01R 12/716 |
| 10,446,972 | B2 * | 10/2019 | Ono | H01R 13/5025 |
| 10,498,070 | B2 * | 12/2019 | Zhou | H01R 13/5202 |
| 2019/0245295 | A1 * | 8/2019 | Ono | H01R 13/5202 |
| 2019/0348785 | A1 * | 11/2019 | Tsai | H01R 13/08 |
| 2021/0111508 | A1 * | 4/2021 | Gu | H01R 43/18 |

* cited by examiner

*Primary Examiner* — Abdullah A Riyami
*Assistant Examiner* — Vladimir Imas
(74) *Attorney, Agent, or Firm* — Birch, Stewart, Kolasch & Birch, LLP

(57) ABSTRACT

A waterproof connector includes a plug-in assembly, an insulating body and a waterproof adhesive block; a rear end of the plug-in assembly is provided with a cavity, the plug-in assembly includes a plurality of conductive terminals, and the conductive terminal is partially exposed in the cavity; a front end of the insulating body is provided with a plug-in groove, a front end of the plug-in assembly is located in the plug-in groove, a rear end of the insulating body is coated on an outer side of the plug-in assembly, and waterproof ports are provided on two sides of the insulating body; the cavity is filled with the waterproof adhesive block, and the waterproof port is at least partially filled with the waterproof adhesive block.

10 Claims, 12 Drawing Sheets

WATERPROOF CONNECTOR

CROSS-REFERENCE TO RELATED APPLICATION(S)

This application claims priority to a Chinese patent application No. 202010013409.2 filed on Jan. 7, 2020, disclosure of which is incorporated herein by reference in its entirety.

TECHNICAL FIELD

The present disclosure relates to the technical field of connectors, and in particular to a waterproof connector.

BACKGROUND

With the development of electronic science and technology, type-c connectors are more and more widely used. After the assembly of a traditional type-c connector, a groove is provided on one side of an insulating body, a waterproof glue is injected and filled into the connector through the groove to make the connector waterproof. However, this method may result in that part of the space on one side of an opening may not be filled with the waterproof glue, and the connector may not meet the specified waterproof requirements.

Therefore, a connector is urgently needed to solve the above technical problems.

SUMMARY

The present disclosure is to provide a waterproof connector capable of enhancing a waterproof effect thereof.

The waterproof connector includes a plug-in assembly, an insulating body and a waterproof adhesive block.

The plug-in assembly is provided with a cavity at a rear end of the plug-in assembly, the plug-in assembly includes a plurality of conductive terminals, and each of the plurality of conductive terminals is partially exposed in the cavity.

The insulating body is provided with a plug-in groove at a front end of the insulating body, a front end of the plug-in assembly is located in the plug-in groove, a rear end of the insulating body is coated on an outer side of the plug-in assembly, and waterproof ports are provided on two sides of the insulating body.

The waterproof adhesive block is injection-molded and filled in the cavity, and each of the waterproof ports is at least partially injection-molded and filled with the waterproof adhesive block.

Alternatively, the plurality of conductive terminals are divided into two groups, which are respectively a first conductive terminal group and a second conductive terminal group, and a plurality of the conductive terminals in each of the first conductive terminal group and the second conductive terminal group is arranged side by side and spaced apart; and the plug-in assembly further comprises a first terminal assembly and a second terminal assembly attached to each other, the first terminal assembly comprises a first insulating block and a second insulating block, the first insulating block is formed at a front end of the first conductive terminal group, at least one side of a front end of each of the plurality of conductive terminals in the first conductive terminal group is exposed from the first insulating block, the second insulating block is formed at a tail of the first conductive terminal group, and the first insulating block and the second insulating block are spaced apart.

Alternatively, the second terminal assembly comprises a third insulating block and a fourth insulating block, the third insulating block is formed at a front end of the second conductive terminal group, at least one side of a front end of each of the plurality of conductive terminals in the second conductive terminal group is exposed from the third insulating block, the fourth insulating block is formed at a tail of the second conductive terminal group, and the third insulating block and the fourth insulating block are spaced apart; and a gap between the first insulating block and the second insulating block and a gap between the third insulating block and the fourth insulating block form the cavity.

Alternatively, the plug-in assembly further comprises a metal spacer and a metal ring, the metal spacer is disposed between the first terminal assembly and the second terminal assembly, and the metal ring is coated on outer sides of rear ends of the first insulating block and the third insulating block.

Alternatively, the plug-in assembly further comprises a first connecting block and a second connecting block, the first connecting block is coated on outer sides of the first insulating block and the third insulating block, two sides of a front end of the metal spacer are exposed from the first connecting block, and an outer surface of the metal ring is exposed from the first connecting block; and the second connecting block is connected to the second insulating block and the fourth insulating block.

Alternatively, left and right sides of the rear end of the plug-in assembly are provided with connecting holes, each of the connecting holes is configured to penetrate the second insulating block and the fourth insulating block, the second connecting block comprises two connecting pillars, a first connecting portion, and a second connecting portion, the two connecting pillars are formed in the two connecting holes, respectively, the first connecting portion is located outside the second insulating block, two ends of the first connecting portion are respectively connected to the two connecting pillars, the second connecting portion is located outside the fourth insulating block, and two ends of the second connecting portion are respectively connected to the two connecting pillars.

Alternatively, the connector further includes a metal socket sleeved outside the plug-in assembly, the metal socket is located at a front end of the cavity, the front end of the plug-in assembly is partially exposed from the metal socket, the insulating body is coated on an outer side of the metal socket, and a docking connector is capable of being inserted into the metal socket.

Alternatively, the connector further includes a shield casing, a first part of the shield casing is coated on one side of the rear end of the plug-in assembly, and a second part of the shield casing is coated on the rear portion of the plug-in assembly and exposed from the insulating body.

Alternatively, the connector further includes a metal member, the metal member is coated on a side of the plug-in assembly away from the shield casing, the metal member is located in the insulating body, two ends of the metal member are provided with first connecting lugs, and the first connecting lugs are exposed from the insulating body.

Alternatively, the connector further includes a waterproof ring, an outer surface of the front end of the insulating body is surrounded with a receiving groove, and the waterproof ring is sleeved in the receiving groove.

With the connector of the present disclosure, the waterproof ports are disposed on two sides of the insulating body, and injection molding is made in the cavity of the plug-in assembly through the two waterproof ports and in the waterproofing ports of the insulating body to form the adhesive block. Injection molding and filling from two sides of the insulating body can ensure that the cavity of the plug-in assembly is completely filled and enhance the waterproof effect of the connector, so that the waterproof capacity of the connector meets the design requirements.

Figure 1:
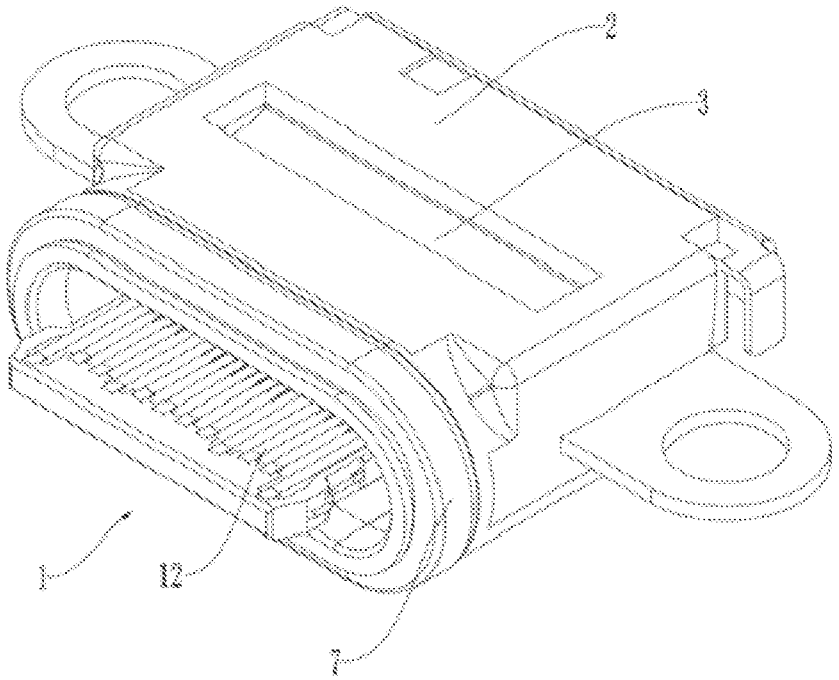
FIG. 1 is a structural view one of a connector according to the present disclosure.

1. Plug-in assembly; 11, Cavity; 12. Conductive terminal;

13. First terminal assembly; 131. First insulating block; 1311. Limiting protrusion; 132. Second insulating block; 1321. First receiving groove; 1322. Groove;

14. Second terminal assembly; 141. Third insulating block; 1411. Limiting hole; 142. Fourth insulating block; 1421. Second receiving groove; 1422. Connecting hole;

15. Metal spacer; 151. Connecting pin; 152. Second connecting lug; 16. Metal ring; 17. First connecting block;

18. Second connecting block; 181. Clamping protrusion; 182. Connecting pillar; 183. First connecting portion; 184. Second connecting portion;

2. Insulating body; 21. Waterproof port; 22. Receiving groove;

3. Waterproof adhesive block;

4. Metal socket; 41. Sleeve portion; 42. Receiving portion;

5. Shield casing; 51. Injection port; 52. Clamping hole; 53. Third connecting lug; 54. First blocking portion; 55. Second blocking portion;

6. Metal part; 61. First connecting lug;

7. Waterproof ring.

DETAILED DESCRIPTION

The technical solutions of the embodiments of the present disclosure will be described clearly and completely in combination with the drawings in the embodiments of the present disclosure. It should be noted that similar reference numerals and letters indicate similar items in the following drawings, so once an item is defined in one drawing, the item need not be further defined and explained in subsequent drawings.

In the description of the present disclosure, it should be noted that the orientations or positional relationships indicated by the terms "on", "below", "left", "right", "vertical", "horizontal", "inside", "outside" etc. are the orientations or positional relationships based on the orientations or positional relationships shown in the drawings, or the orientations or positional relationships in which a product of the present disclosure is commonly placed in use, and are merely for the convenience of describing the present disclosure and simplifying the description rather than for the indication or implication that the device or element referred to must have a specific orientation and structure and operation in a specific orientation, and thus cannot be understood as a limitation to the present disclosure. In addition, the terms "first", "second" and "third" are used merely for distinguishing descriptions and should not be understood as indicating or implying relative importance. In the description of the present disclosure, unless otherwise stated, "a plurality" refers to two or more.

In the description of the present disclosure, it should also be noted that unless otherwise expressly specified and limited, the terms "dispose" and "connect" should be understood in a broad sense, for example, as fixed connection, detachable connection or integral connection; as mechanical connection or electrical connection. For those of ordinary skill in the art, the specific meanings of the above terms in the present disclosure may be understood in specific cases.

In the present disclosure, unless otherwise expressly specified and limited, when a first feature is described as "on" or "below" a second feature, the first feature and the second feature may be in direct contact, or be in contract via another feature between the two features instead of being in direct contact. Moreover, when the first feature is described as "on", "above" or "over" the second feature, the first feature is right on, above or over the second feature or the first feature is obliquely on, above or over the second feature, or the first feature is simply at a higher level than the second feature. When the first feature is described as "below", "under" or "underneath" the second feature, the first feature is right below, under or underneath the second feature or the first feature is obliquely below, under or underneath the second feature, or the first feature is simply at a lower level than the second feature.

The embodiments of the present disclosure will be described in detail below, and the examples of the embodiments are shown in the drawings, where the same or similar reference numerals represent the same or similar elements or the elements with same or similar functions. The embodiments described below with reference to the drawings are exemplary and are merely used for explaining the present disclosure, and should not be understood as a limitation to the present disclosure.

As shown in FIGS. 1 to 17, this embodiment discloses a waterproof connector including a plug-in assembly 1, an insulating body 2, and a waterproof adhesive block 3.

As shown in FIGS. 1 to 4, a rear end of the plug-in assembly 1 is provided with a cavity 11, the plug-in assembly 1 includes a plurality of conductive terminals 12, and the conductive terminal 12 is partially exposed in the cavity 11. A front end of the insulating body 2 is provided with a plug-in groove, a front end of the plug-in assembly 1 is located in the plug-in groove, a rear end of the insulating body 2 is coated on an outer side of the plug-in assembly 1, and two sides of the insulating body 2 are provided with waterproof ports 21. The cavity 11 is filled with the waterproof adhesive block 3, and the waterproof port 21 is at least partially filled with the waterproof adhesive block 3. Alternatively, in the embodiment, half of the waterproof port 21 is filled with the waterproof adhesive block 3, and the material of the waterproof adhesive block 3 is silicone.

The waterproof ports 21 are disposed on two sides of the insulating body 2. Injection molding is made in the cavity 11 of the plug-in assembly 1 through the two waterproof ports 21 and in the water-proof ports 21 of the insulating body 2 to form the waterproof adhesive block 3. The injection molding and filling from two sides of the insulating body 2 can ensure that the cavity 11 of the plug-in assembly 1 is completely filled to enhance the waterproof effect of the connector, so that the waterproof ability of the connector meets the design requirements.

Specifically, the conductive terminals 12 are divided into two groups, namely a first conductive terminal group and a second conductive terminal group, a plurality of conductive terminals 12 in the first conductive terminal group is arranged side by side and spaced apart, and a plurality of conductive terminals in the second conductive terminal group is arranged side by side and spaced apart. Tail ends of the conductive terminals 12 in the first conductive terminal group and the second conductive terminal group are located on the same plane, and are staggered to facilitate soldering connection of a circuit board.

Figure 5:
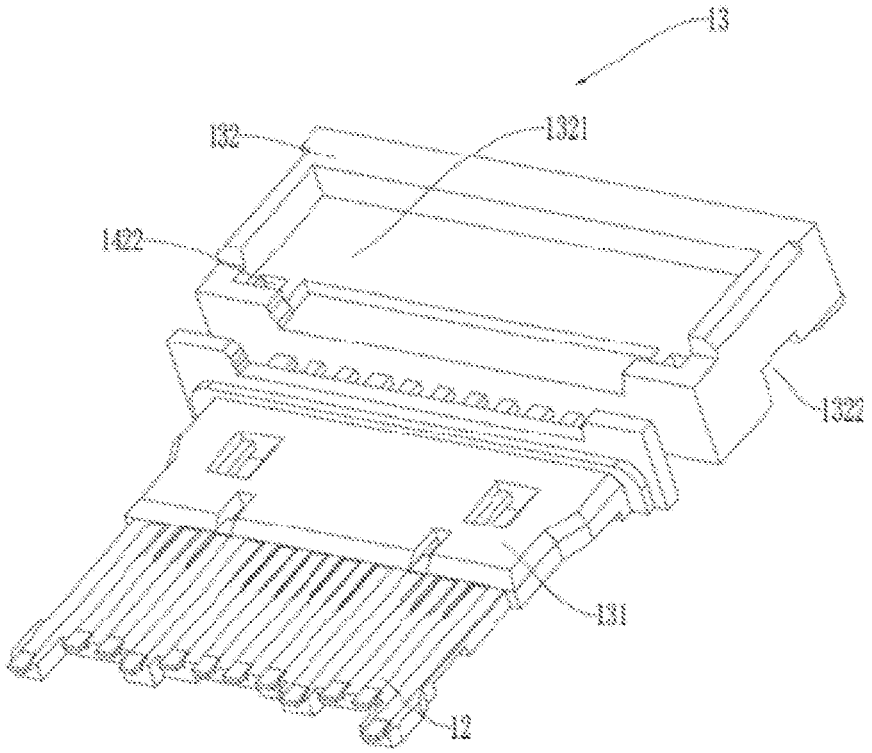
FIG. 5 is a structural view one of a first terminal assembly according to the present disclosure.
Figure 6:
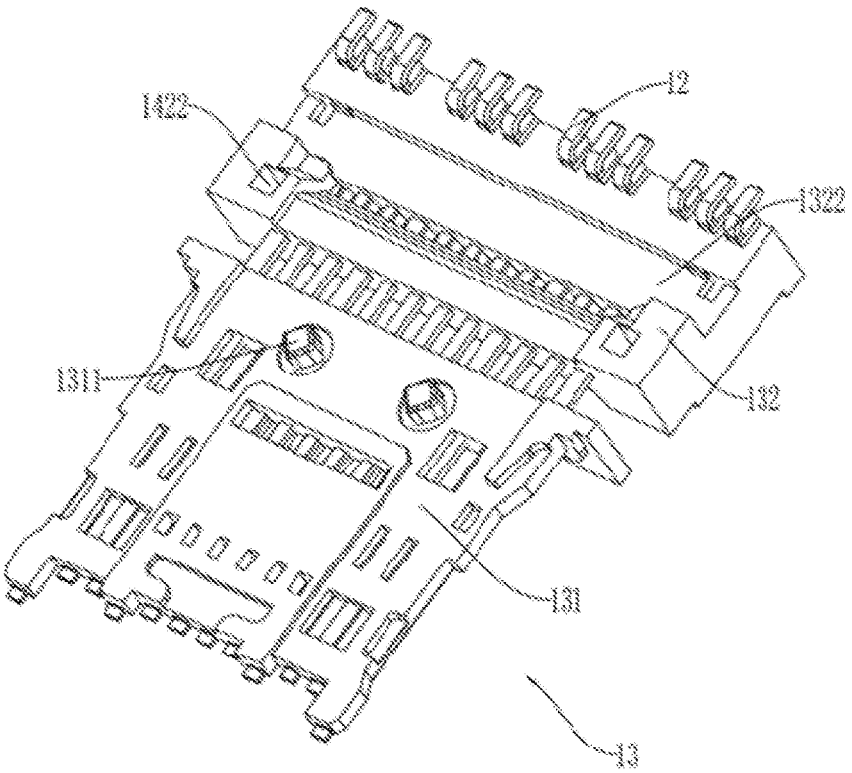
FIG. 6 is a structural view two of a first terminal assembly according to the present disclosure.

As shown in FIGS. 5 and 6, the plug-in assembly 1 includes a first terminal assembly 13 and a second terminal assembly 14 attached to each other, and the first terminal assembly 13 includes a first insulating block 131 and a second insulating block 132. The first insulating block 131 is formed at a front end of the first conductive terminal group, and at least one side of a front end of a conductive terminal 12 in the first conductive terminal group is exposed from the first insulating block 131. Alternatively, in this embodiment, the first insulating block 131 is injection-molded at the front end of the first conductive terminal group; a tail end of the first insulating block 131 is coated on the conductive terminals 12 of the first conductive terminal group, and a front end of the first insulating block 131 is partially coated on the conductive terminals 12, so that parts of the left and right sides and the outer side of the conductive terminal 12 are exposed from the first insulating block 131, which is convenient for abutment against a signal terminal of a docking connector and connection of the connector to the mating connector. An inner surface of the first insulating block 131 is provided with at least two limiting protrusions 1311, alternatively two in this embodiment. The second insulating block 132 is formed at a tail of the first conductive terminal group (specifically, the second insulating block 132 is injection-molded at the tail of the first conductive terminal group), and a tail end of the conductive terminal 12 in the first conductive terminal group is exposed from a rear end of the second insulating block 132, so as to be soldering connected to the circuit board. The first insulating block 131 and the second insulating block 132 are spaced apart, and a gap between the first insulating block 131 and the second insulating block 132 is formed with a first sub-cavity.

Figure 7:
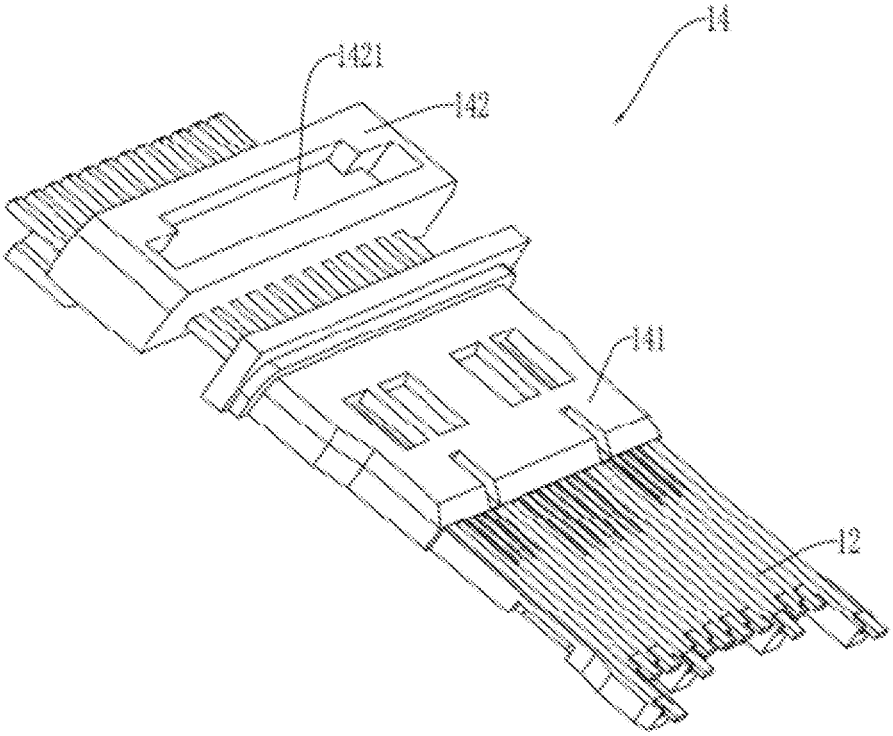
FIG. 7 is a structural view one of a second terminal assembly according to the present disclosure.
Figure 8:
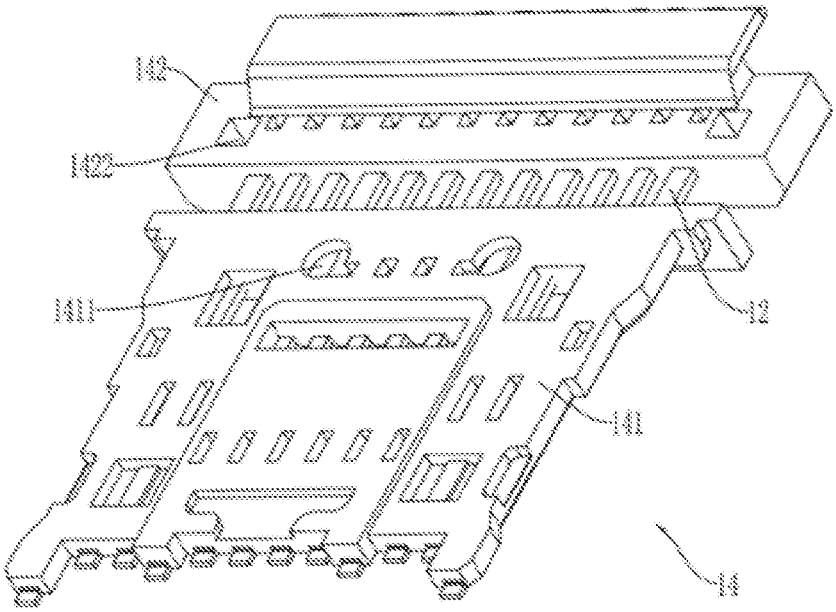
FIG. 8 is a structural view two of a second terminal assembly according to the present disclosure.

As shown in FIGS. 7 and 8, the second terminal assembly 14 includes a third insulating block 141 and a fourth insulating block 142. The third insulating block 141 is formed at a front end of the second conductive terminal group, and at least one side of the front end of a conductive terminal 12 in the second conductive terminal group is exposed from the third insulating block 141. Alternatively, in this embodiment, the third insulating block 141 is injection-molded at the front end of the second conductive terminal group; a tail end of the third insulating block 141 is coated on the conductive terminals 12 of the second conductive terminal group, and a front end of the third insulating block 141 is partially coated on the conductive terminals 12, so that parts of the left and right sides and the outer side of the conductive terminal 12 are exposed from the third insulating block 141, which is convenient for abutment against the signal terminal of the docking connector and connection of the connector to the docking connector. An inner surface of the third insulating block 141 is provided with a limiting hole 1411 matching the limiting protrusion 1311. In this embodiment, the number of limiting holes 1411 is two. During the assembly of the first terminal assembly 13 and the second terminal assembly 14, the limiting protrusion 1311 can be inserted into the limiting hole 1411 to limit the positions of the first terminal assembly 13 and the second terminal assembly 14 so as to prevent the first terminal assembly 13 and the second terminal assembly 14 from dislocation. The fourth insulating block 142 is formed at a tail of the second conductive terminal group (specifically, the fourth insulating block 142 is injection-molded at the tail of the second conductive terminal group), the third insulating block 141 and the fourth insulating block 142 are spaced apart, and a gap between the third insulating block 141 and the fourth insulating block 142 is formed with a second sub-cavity. The first sub-cavity and the second sub-cavity form the cavity 11 of the plug-in assembly 1, that is, the gap between the first insulating block 131 and the second insulating block 132 and the gap between the third insulating block 141 and the fourth insulating block 142 form the cavity 11 of the plug-in assembly 1.

Figure 9:
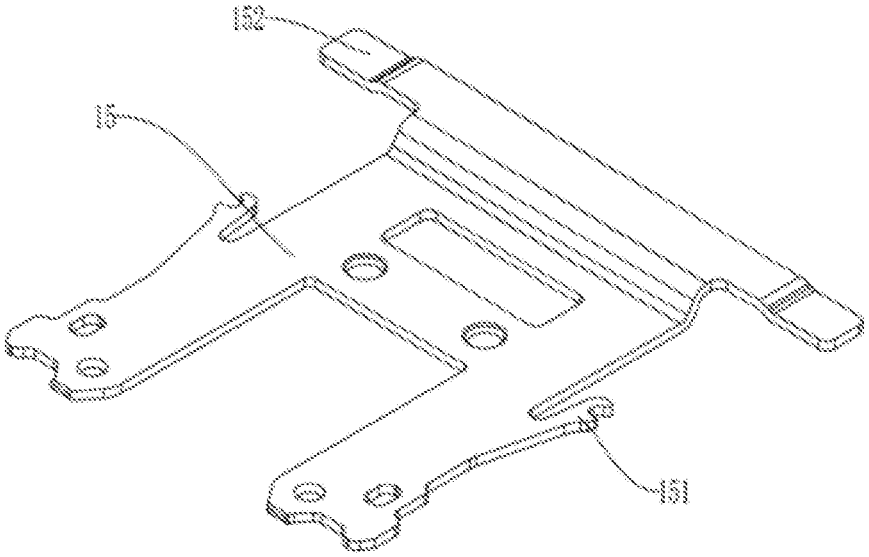
FIG. 9 is a structural view of a metal spacer according to the present disclosure.
Figure 10:
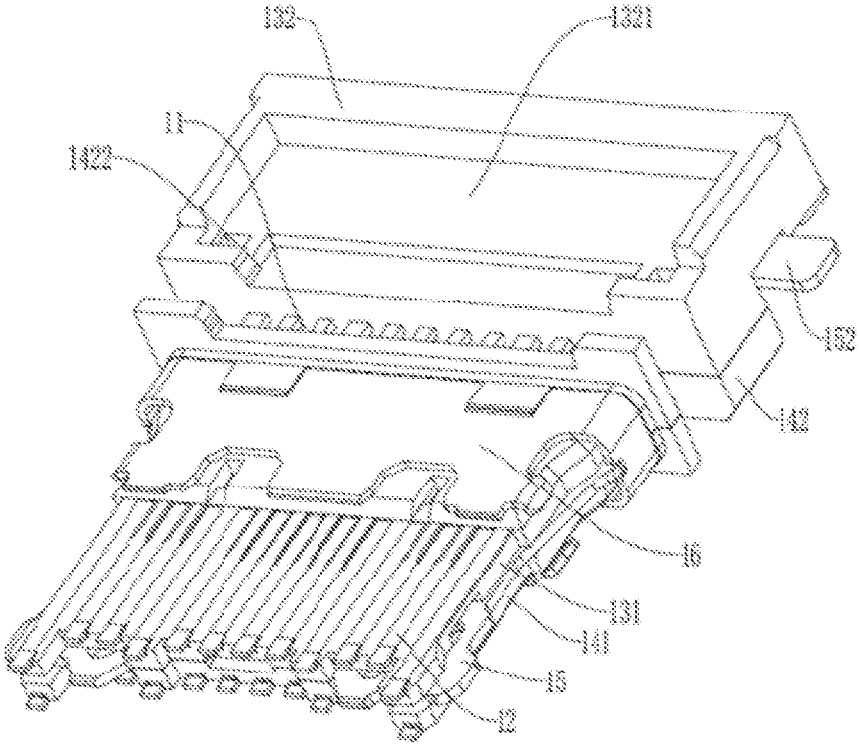
FIG. 10 is a partial structural view one of a plug-in assembly according to the present disclosure.
Figure 11:
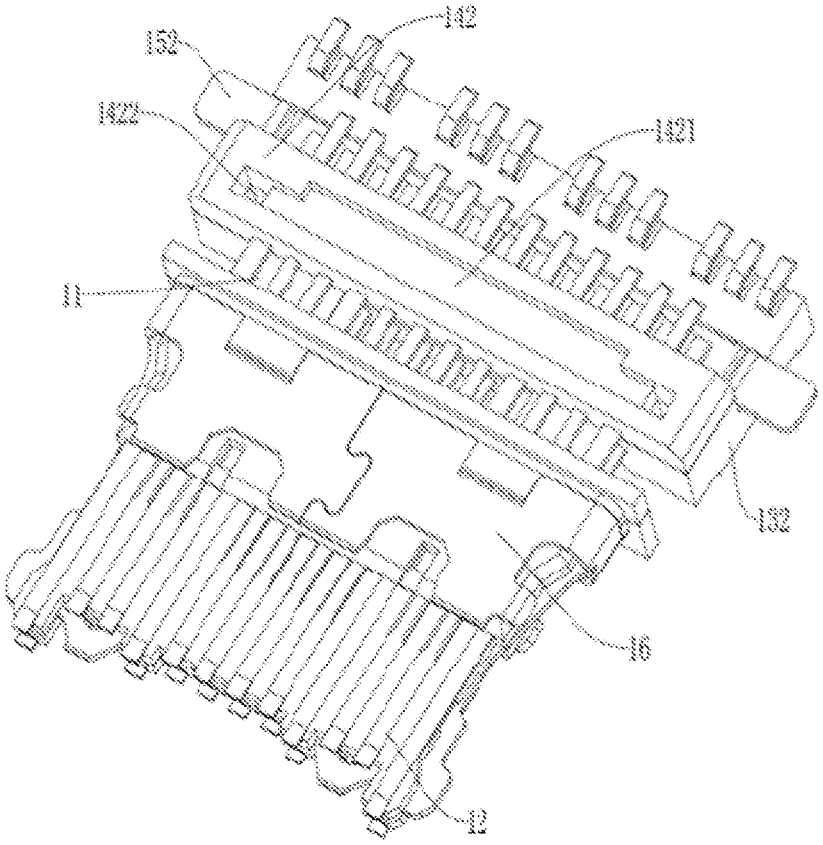
FIG. 11 is a partial structural view two of a plug-in assembly according to the present disclosure.
Figure 12:
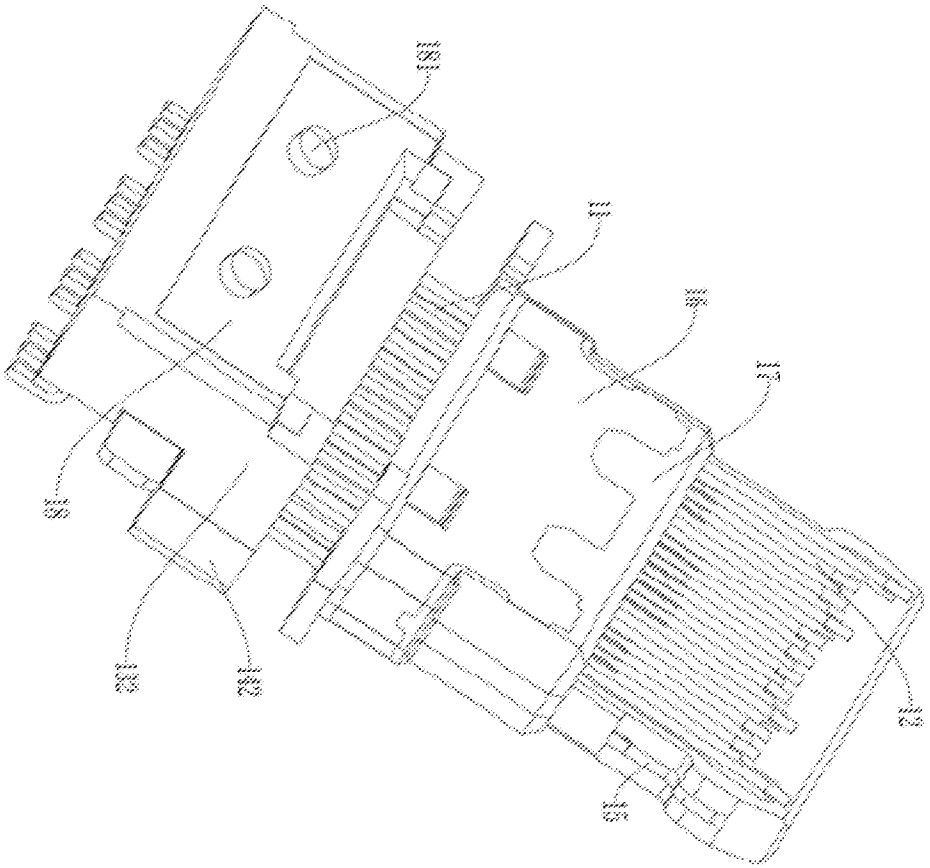
FIG. 12 is a structural view of a plug-in assembly according to the present disclosure.
Figure 13:
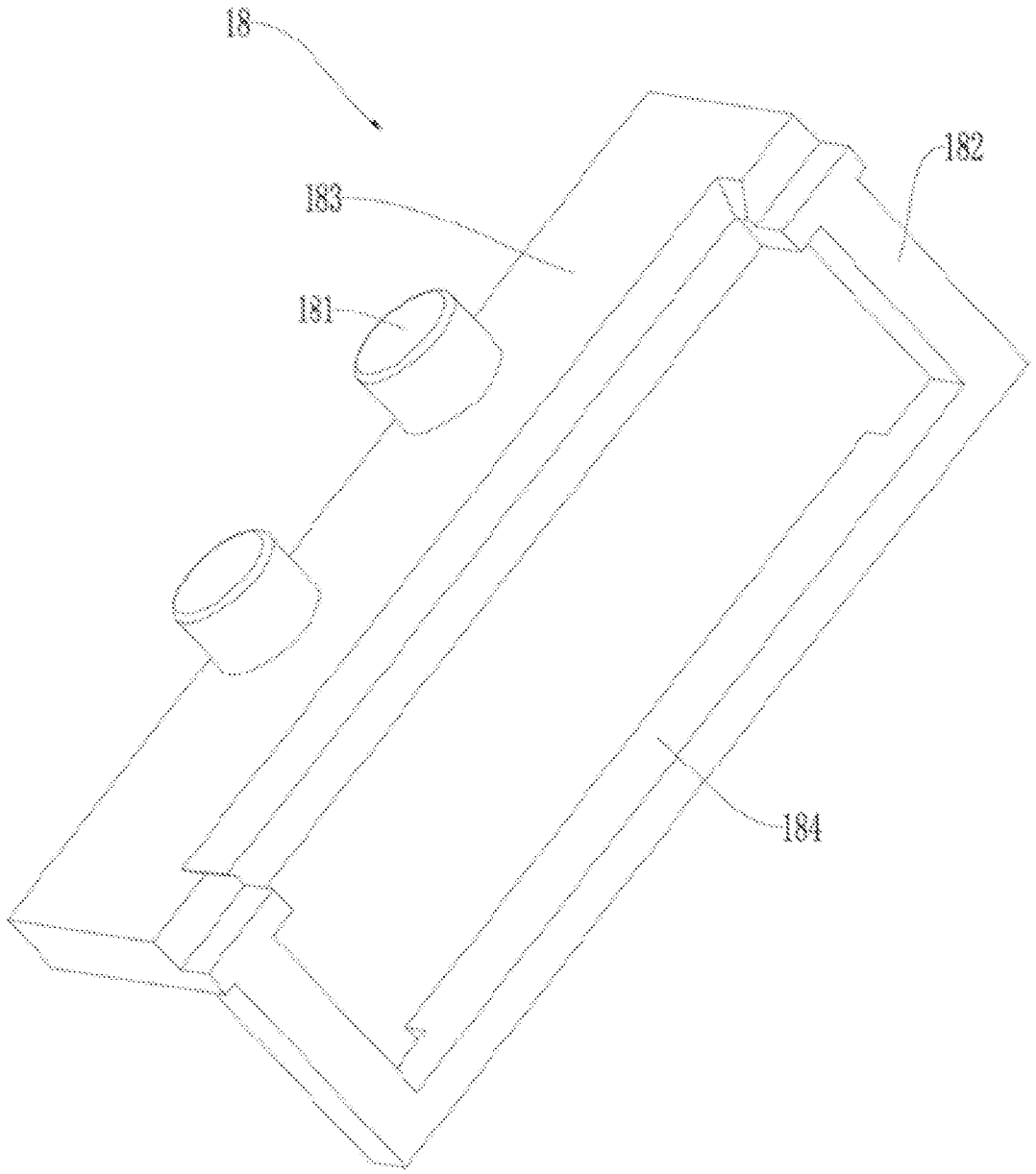
FIG. 13 is a structural view of a second connecting block according to the present disclosure.
Figure 14:
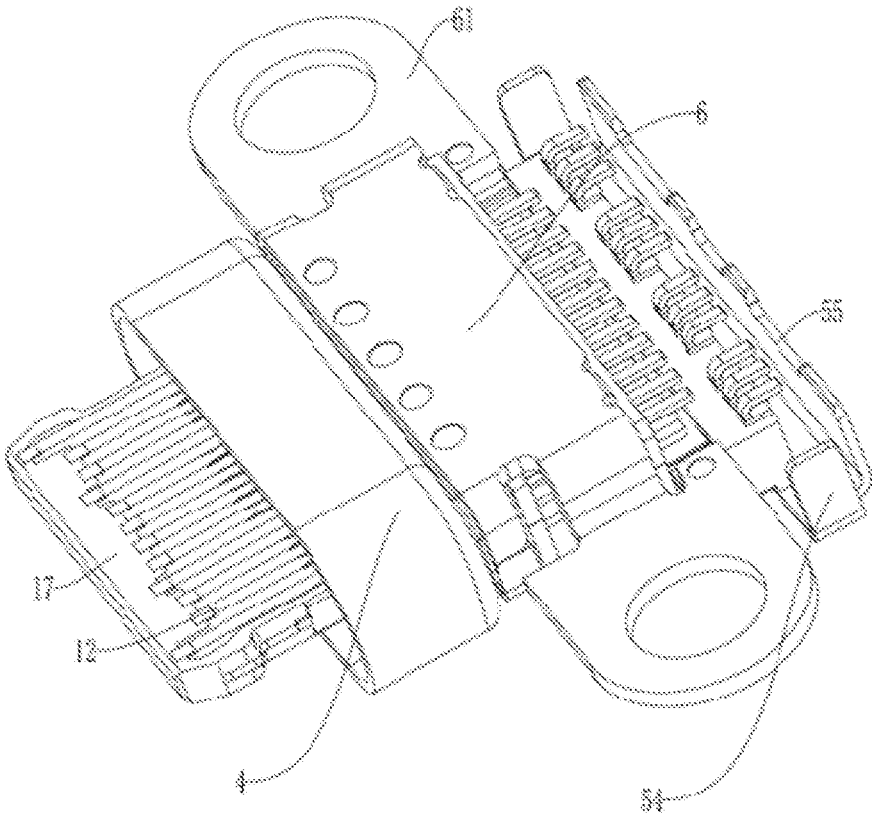
FIG. 14 is a structural view one of a connector according to the present disclosure (excluding an insulating body and a waterproof adhesive block)

As shown in FIGS. 9 to 11, optionally, the plug-in assembly 1 further includes a metal spacer 15 and a metal ring 16. The metal spacer 15 is provided between the first terminal assembly 13 and the second terminal assembly 14. Specifically, the metal spacer 15 is provided with a mating hole mated with the limiting protrusion 1311. In this embodiment, the number of mating holes is two. During the assembly process of the plug-in assembly 1, the limiting protrusion 1311 can be inserted into the limiting hole 1411 and the mating hole to limit the positions of the metal spacer 15 and the second terminal assembly 14 so as to prevent the metal spacer 15 and the second terminal assembly 14 from dislocation relative to the first terminal assembly 13. Left and right sides of the metal spacer 15 are provided with connecting pins 151, and left and right sides of a tail of the metal spacer 15 extend outward with second connecting lugs 152. A groove 1322 is disposed on an inner surface of the second insulating block 132, a portion having the second connecting lug 152 is located in the groove 1322, and the second connecting lugs 152 are exposed from side walls of the second insulating block 132. The metal ring 16 is coated on outer sides of rear ends of the first insulating block 131 and the third insulating block 141. The two connecting pins 151 of the metal spacer 15 abut against the metal ring 16 and conduct the metal ring 16 and the metal spacer 15. Tail ends of the first insulating block 131 and the third insulating block 141 are surrounded outward with stoppers, and the metal ring 16 is located at a front end of the stopper.

Optionally, as shown in FIGS. 10 to 13, the plug-in assembly 1 further includes a first connecting block 17 and a second connecting block 18, the first connecting block 17 is coated on outer sides of the first insulating block 131 and the third insulating block 141 and is mainly formed on left and right sides and front ends of the first insulating block 131 and the third insulating block 141, and the front end of the first insulating block 131, the front end of the third insulating block 141, the front end of the conductive terminal 12, and a front end of the first connecting block 17 collectively form a tongue of the plug-in assembly 1. Specifically, the first connecting block 17 is formed on outer sides of the first insulating block 131 and the third insulating block 141 by injection molding. After formation, two sides of a front end of the metal spacer 15 are each partially exposed from the first connecting block 17, and an outer surface of the metal ring 16 is exposed from the first connecting block 17. When the connector is plugged with the docking connector, two sides of the metal spacer 15 is capable of abutting against a metal casing or a locking member of the docking connector, and the portion of the metal ring 16 exposed from the first connecting block 17 is capable of abutting against the metal casing of the docking connector.

The second connecting block 18 is connected to the second insulating block 132 and the fourth insulating block 142. Specifically, left and right sides of the rear end of the plug-in assembly 1 are provided with connecting holes 1422, the connecting hole 1422 is configured to penetrate the second insulating block 132 and the fourth insulating block 142, the second connecting block 18 includes two connecting pillars 182, a first connecting portion 183, and a second connecting portion 184, and the two connecting pillars 182 are formed in the two connecting holes 1422 respectively. A first receiving groove 1321 is provided on an outer surface of the second insulating block 132, the first connecting portion 183 is located on an outer side of the second insulating block 132 and specifically formed in the first receiving groove 1321, the first connecting portion 183 is provided with two clamping protrusions 181, and two ends of the first connecting portion 183 are respectively connected to ends of the two connecting pillars 182 exposed from the second insulating block 132. A second receiving groove 1421 is provided on an outer surface of the fourth insulating block 142, the second connecting portion 184 is located on an outer side of the fourth insulating block 142 and specifically formed in the second receiving groove 1421, and two ends of the second connecting portion 184 are respectively connected to ends of the two connecting pillars 182 exposed from the fourth insulating block 142. The second insulating block 132 is integrally formed on the fourth insulating block 142 by injection molding.

Optionally, as shown in FIGS. 14 to 17, the connector further includes a metal socket 4, a shield casing 5 and a metal member 6. The metal socket 4 includes a sleeve portion 41 and a receiving portion 42 connected to each other. An outer diameter of the receiving portion 42 is much larger than an outer diameter of the sleeve portion 41, and the receiving portion 42 is mainly used for receiving the portion of the docking connector inserted into the connector. The metal socket 4 is sleeved on an outer side of the plug-in assembly 1, and specifically, the sleeve portion 41 is sleeved on outer sides of the first insulating block 131 and the third insulating block 141 and is located on a front side of the stopper, that is, the metal socket 4 is located at a front end of the cavity 11. The front end of plug-in assembly 1 is partially exposed from the metal socket 4. Specifically, the tongue of the plug-in assembly 1 is exposed from the metal socket 4, the insulating body 2 is coated on an outer side of the metal socket 4, the insulating body 2 protrudes forward from the metal socket 4, and the docking connector can be inserted into the metal socket 4.

Figure 15:
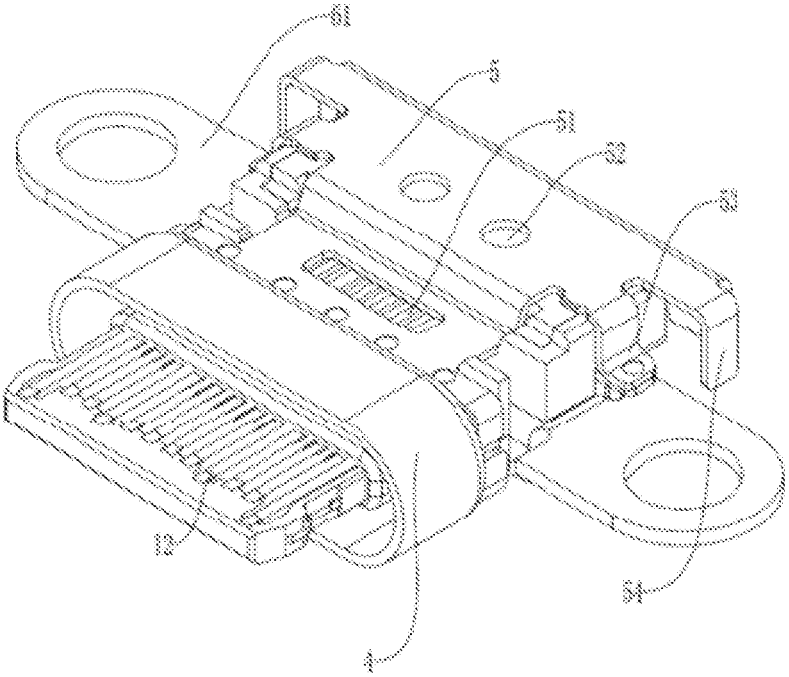
FIG. 15 is a structural view two of a connector according to the present disclosure (excluding an insulating body and a waterproof adhesive block)
Figure 16:
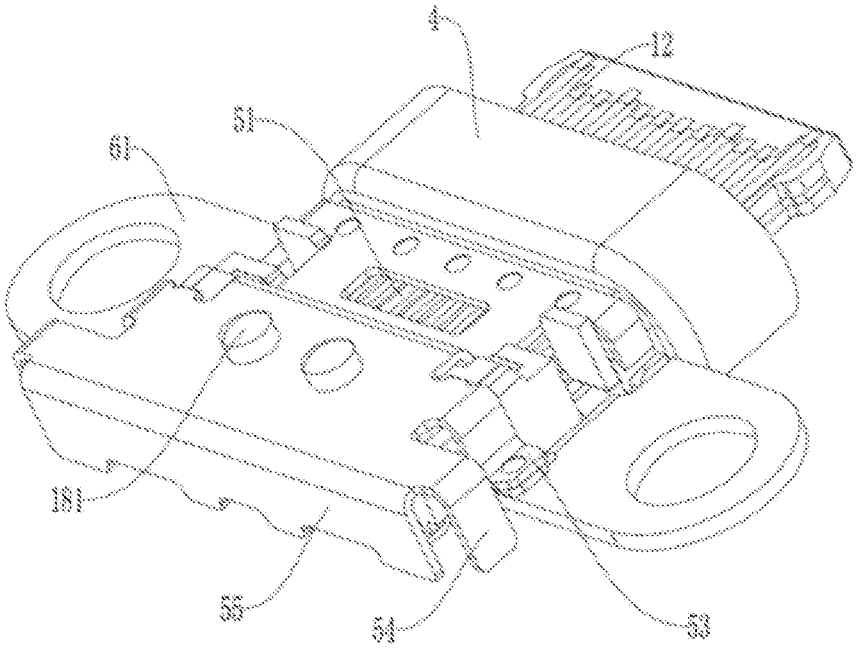
FIG. 16 is a structural view three of a connector according to the present disclosure (excluding an insulating body and a waterproof adhesive block)
Figure 17:
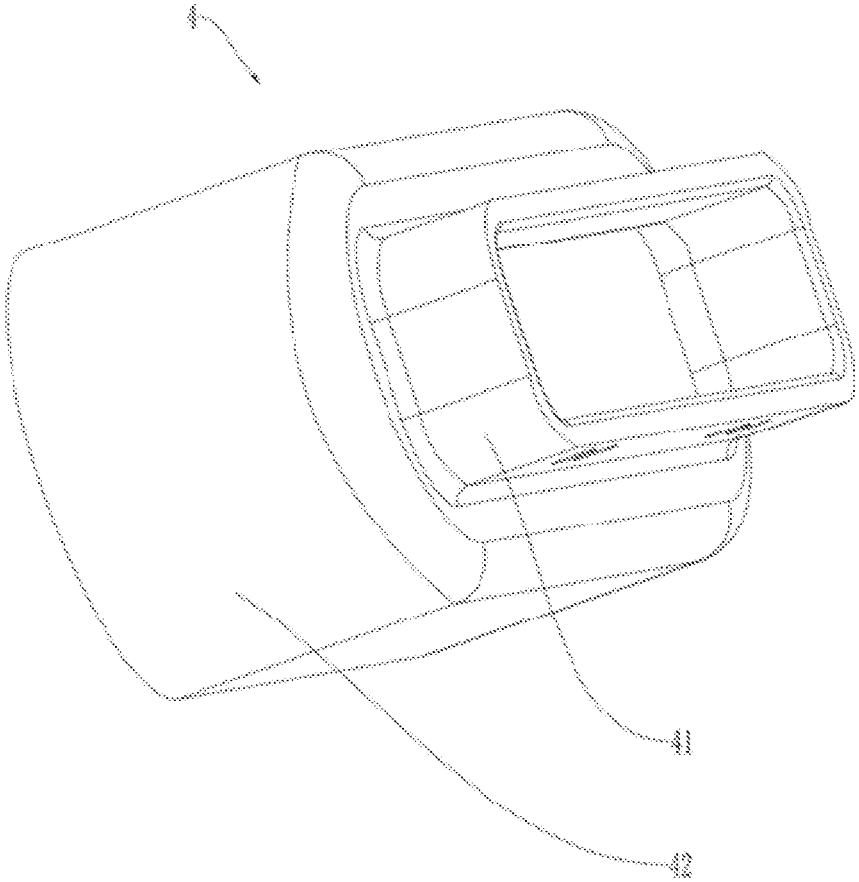
FIG. 17 is a structural view of a metal socket according to the present disclosure.
Figure 18:
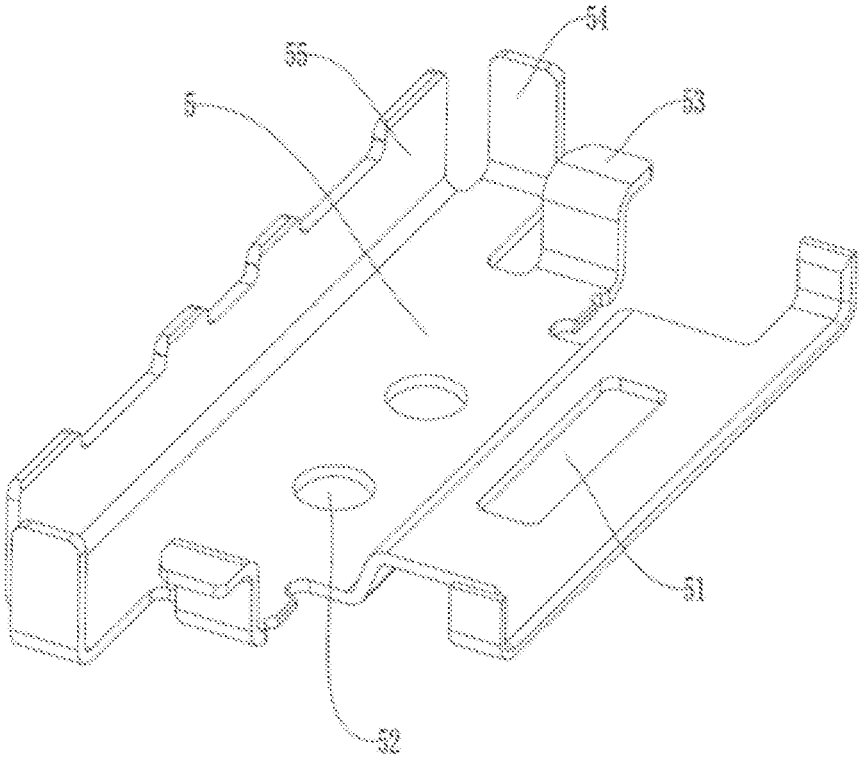
FIG. 18 is a structural view of a shield casing according to the present disclosure.

As shown in FIGS. 15, 16 and 18, part of the shield casing 5 is coated on one side of the rear end of the plug-in assembly 1, this part is a first part, and the other part is a second part. The first part is coated on outer sides of the second insulating block 132 and the sleeve portion 41 of the metal socket 4, and an injection molding port 51 is provided on the first part to facilitate injection molding of the waterproof adhesive block 3. The first part is provided with clamping holes 52 mated with the two clamping protrusions 181, and the clamping hole 52 is sleeved on the clamping protrusion 181 to limit the position of the shield casing 5. The first part is located on the insulating body 2, left and right sides of the first part extend with third connecting lugs 53, the third connecting lug 53 extends outside of the insulating body 2, and the third connecting lug 53 abuts against the second connecting lug 152 of the metal spacer 15.

The second part is coated on the rear portion of the plug-in assembly 1, and is exposed from the insulating body 2. Two sides of the second part extends with first blocking portions 54 in the direction of the fourth insulating block 142, and a rear end of the second part is formed with a second blocking portion 55 in the direction of the fourth insulating block 142. The shield casing 5 mainly plays a role of shielding interference signals, and can ensure the quality of signal transmission by the conductive terminal 12. The metal member 6 is coated on a side of the plug-in assembly 1 away from the shield casing 5, and specifically, the metal member 6 is coated on the outer side of the fourth insulating block 142 and the outer side of the sleeve portion 41 of the metal socket 4. The metal member 6 is located in the insulating body 2, two ends of the metal member 6 are provided with first connecting lugs 61, the first connecting lug 61 is exposed from the insulating body 2, and the first connecting lug 61 partially abuts against a side of the second connecting lug 152 close to the fourth insulating block 142. The first connecting lug 61, the second connecting lug 152 and the third connecting lug 53 are fixedly connected by stamping rivets. The first connecting lug 61 is provided with a through hole, which is convenient for the connector to be fixed on an external device.

Figure 2:
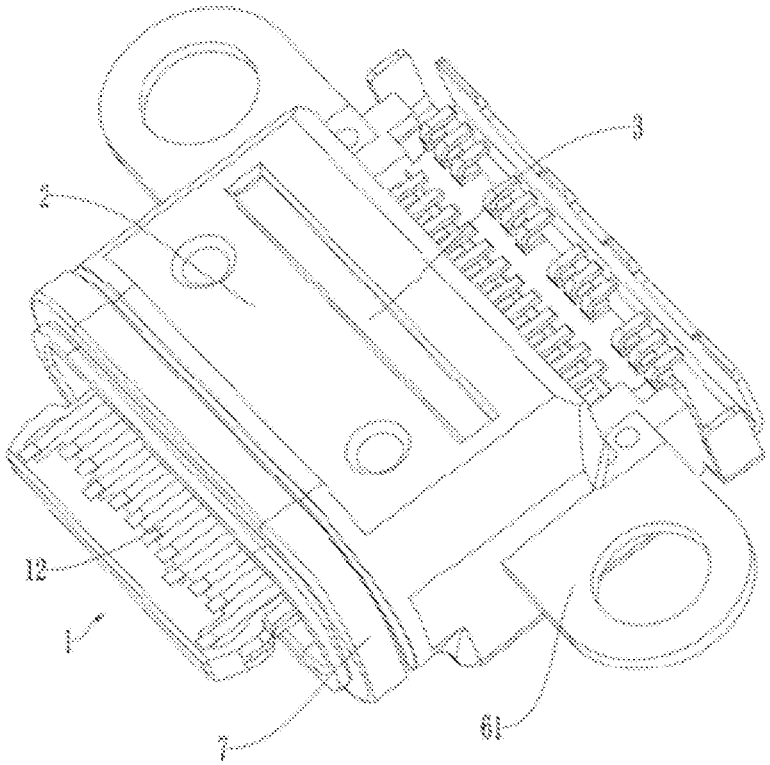
FIG. 2 is a structural view two of a connector according to the present disclosure.
Figure 3:
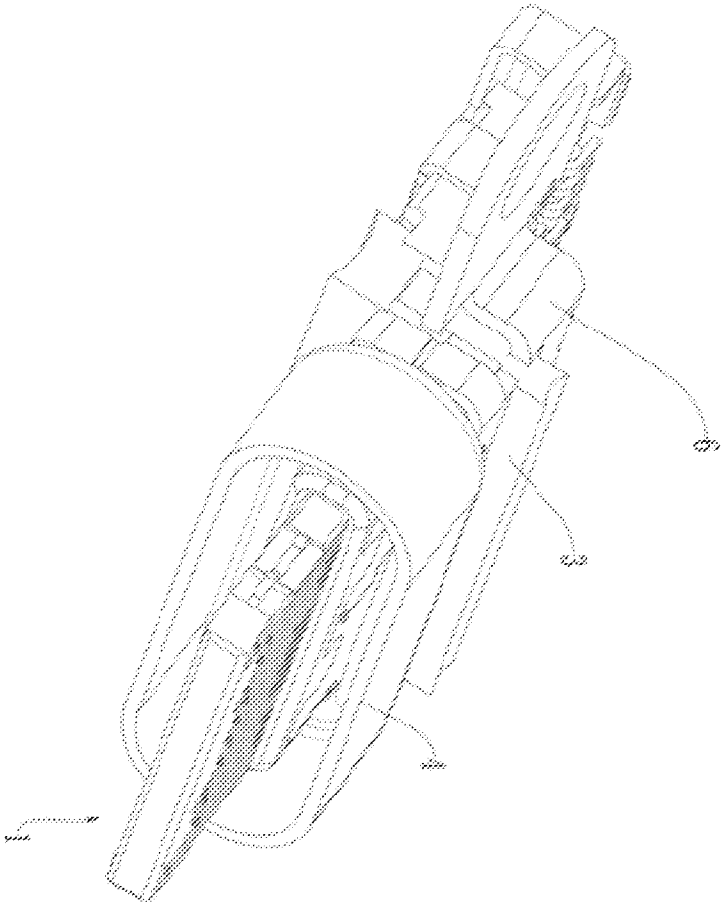
FIG. 3 is a structural view of a connector according to the present disclosure (excluding an insulating body)
Figure 4:
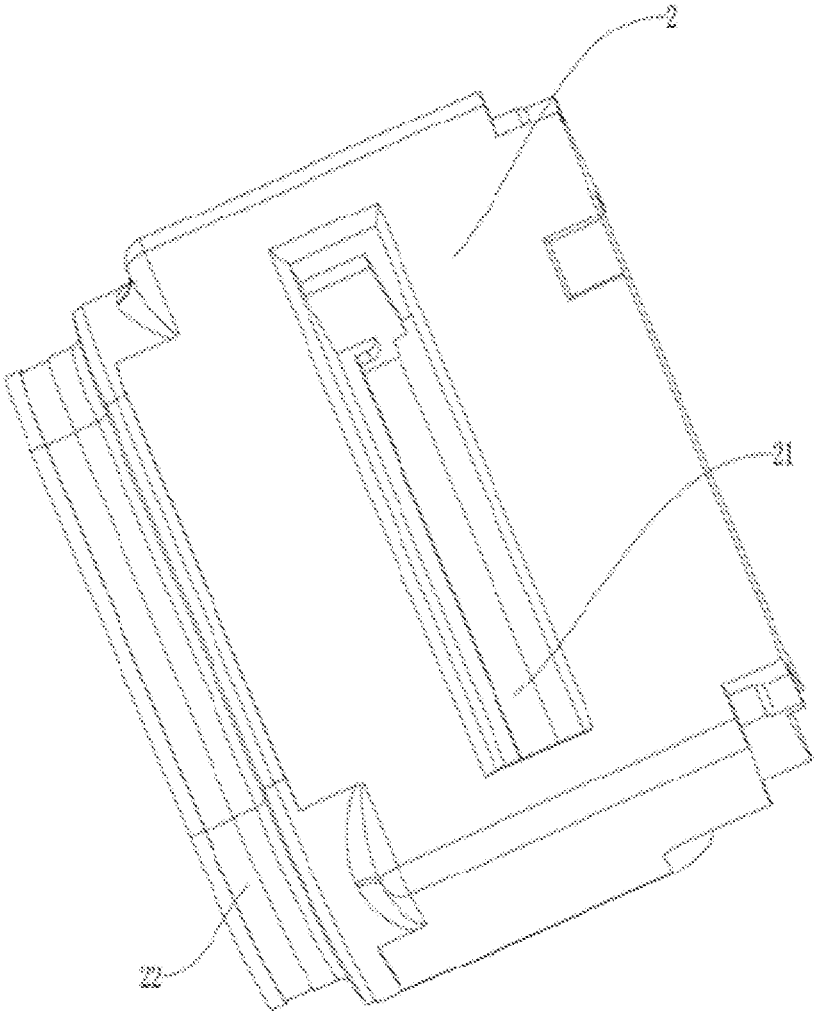
FIG. 4 is a structural view of an insulating body according to the present disclosure.

Optionally, still referring to FIGS. 1, 2, and 4, the connector further includes a waterproof ring 7, an outer surface of the front end of the insulating body 2 is surrounded with a receiving groove 22, and specifically, the receiving groove 22 is disposed on a portion of the insulating body 2 protruding forward from the metal socket 4, and the waterproof ring 7 is sleeved in the receiving groove 22. The waterproof ring 7 is a waterproof silicone soft ring, and the waterproof ring 7 is capable of sealing a joint between the connector and the docking connector to ensure the sealing effect of the connector and the docking connector.

The assembly process of the connector is as follows. The first insulating block 131 and the second insulating block 132 are formed on the first conductive terminal group by high temperature injection molding to form the first terminal assembly 13; the third insulating block 141 and the fourth insulating block 142 are formed on the second conductive terminal group to form the second terminal assembly 14.

The metal spacer 15 is placed between the first terminal assembly 13 and the second terminal assembly 14, and the metal ring 16 is sleeved on the first insulating block 131 and the third insulating block 141.

The first connecting block 17 is formed on the first insulating block 131 and the third insulating block 141 by high temperature injection molding, and the second connecting block 18 is formed on the second insulating block 132 and the fourth insulating block 142 to form the plug-in assembly 1.

The metal socket 4, the metal member 6 and the shield casing 5 are assembled on the plug-in assembly 1.

The insulating body 2 is formed on the outer sides of the plug-in assembly 1, the metal socket 4, the metal member 6, and the shield casing 5 by high temperature injection molding.

The waterproof ring 7 is formed in the receiving groove 22 of the insulating body 2 by high temperature injection molding.

The waterproof adhesive block 3 is formed in the cavity 11 of the plug-in assembly 1 and the waterproof ports 21 of the insulating body 2 by high temperature injection molding.

Apparently, the embodiments of the present disclosure described above are merely examples for clearly explaining the present disclosure, and are not intended to limit the embodiments of the present disclosure. For those of ordinary skill in the art, other different forms of changes or modifications can be made on the basis of the above description. Embodiments of the present disclosure cannot be and do not need to be exhausted herein. Any modification, equivalent substitution, improvement and the like made within the spirit and principle of the present disclosure shall fall in the protection scope of the claims of the present disclosure.

What is claimed is:

1. A waterproof connector, comprising:

a plug-in assembly provided with a cavity at a rear end of the plug-in assembly, wherein the plug-in assembly comprises a plurality of conductive terminals, and each of the plurality of conductive terminals is partially exposed in the cavity; an insulating body provided with a plug-in groove at a front end of the insulating body, wherein a front end of the plug-in assembly is located in the plug-in groove, a rear end of the insulating body is coated on an outer side of the plug-in assembly, and waterproof ports are provided on two sides of the insulating body; and a waterproof adhesive block, wherein the cavity is injection-molded and filled with the waterproof adhesive block, and each of the waterproof ports is at least partially injection-molded and filled with the waterproof adhesive block.

2. The connector according to claim 1, wherein:

the plurality of conductive terminals is divided into two groups which are respectively a first conductive terminal group and a second conductive terminal group, a plurality of conductive terminals in each of the first conductive terminal group and the second conductive terminal group is arranged side by side and spaced apart; and the plug-in assembly further comprises a first terminal assembly and a second terminal assembly attached to each other, the first terminal assembly comprises a first insulating block and a second insulating block, the first insulating block is formed at a front end of the first conductive terminal group, at least one side of a front end of each of the plurality of conductive terminals in the first conductive terminal group is exposed from the first insulating block, the second insulating block is formed at a tail of the first conductive terminal group, and the first insulating block and the second insulating block are spaced apart.

3. The waterproof connector according to claim 2, wherein:

the second terminal assembly comprises a third insulating block and a fourth insulating block, the third insulating block is formed at a front end of the second conductive terminal group, at least one side of a front end of each of the plurality of conductive terminals in the second conductive terminal group is exposed from the third insulating block, the fourth insulating block is formed at a tail of the second conductive terminal group, and the third insulating block and the fourth insulating block are spaced apart; and a gap between the first insulating block and the second insulating block and a gap between the third insulating block and the fourth insulating block form the cavity.

4. The waterproof connector according to claim 3, wherein:

the plug-in assembly further comprises a metal spacer and a metal ring, the metal spacer is disposed between the first terminal assembly and the second terminal assembly, and the metal ring is coated on outer sides of rear ends of the first insulating block and the third insulating block.

5. The waterproof connector according to claim 4, wherein:

the plug-in assembly further comprises a first connecting block and a second connecting block, the first connecting block is coated on outer sides of the first insulating block and the third insulating block, two sides of a front end of the metal spacer are exposed from the first connecting block, and an outer surface of the metal ring is exposed from the first connecting block; and the second connecting block is connected to the second insulating block and the fourth insulating block.

6. The waterproof connector according to claim 5, wherein:

left and right sides of the rear end of the plug-in assembly are provided with connecting holes, each of the connecting holes is configured to penetrate the second insulating block and the fourth insulating block, the second connecting block comprises two connecting pillars, a first connecting portion, and a second connecting portion the two connecting pillars are formed in the two connecting holes respectively, the first connecting portion is located outside the second insulating block, two ends of the first connecting portion are respectively connected to the two connecting pillars, the second connecting portion is located outside the fourth insulating block, and two ends of the second connecting portion are respectively connected to the two connecting pillars.

7. The waterproof connector according to claim 1, further comprising a metal socket sleeved outside the plug-in assembly, the metal socket is located at a front end of the cavity, the front end of the plug-in assembly is partially exposed from the metal socket, the insulating body is coated on an outer side of the metal socket, and a docking connector is capable of being inserted into the metal socket.

8. The waterproof connector according to claim 1, further comprising a shield casing, a first part of the shield casing is coated on one side of the rear end of the plug-in assembly, and a second part of the shield casing is coated on the rear portion of the plug-in assembly and exposed from the insulating body.

9. The waterproof connector according to claim 8, further comprising a metal member, the metal member is coated on a side of the plug-in assembly away from the shield casing, the metal member is located in the insulating body, two ends of the metal member are provided with first connecting lugs, and the first connecting lugs are exposed from the insulating body.

10. The waterproof connector according to claim 1, further comprising a waterproof ring, an outer surface of the front end of the insulating body is surrounded with a receiving groove, and the waterproof ring is sleeved in the receiving groove.

* * * * *